United States Patent [19]

Hall

[11] 3,949,931

[45] Apr. 13, 1976

[54] TAMPER-PROOF CONTAINER

[75] Inventor: Richard A. Hall, Pleasanton, Calif.

[73] Assignee: Willamette Industries, Inc., San Leandro, Calif.

[22] Filed: Jan. 27, 1975

[21] Appl. No.: 544,362

[52] U.S. Cl. ..... 229/36; 229/45 R; 206/807

[51] Int. Cl.[2] ..... B65D 5/22; B65D 45/00

[58] Field of Search ..... 229/34, 36, 45; 206/807

[56] References Cited

UNITED STATES PATENTS

| | | | |
|---|---|---|---|
| 3,023,945 | 3/1962 | Layne, Sr. | 229/36 |
| 3,112,058 | 11/1963 | Martin | 229/36 |
| 3,368,735 | 2/1968 | Levi | 229/36 X |
| 3,510,047 | 5/1970 | Pascus et al. | 229/36 |
| 3,543,995 | 12/1970 | Wilson | 229/36 |
| 3,826,420 | 7/1974 | Bamburg et al. | 229/45 |

*Primary Examiner*—Davis T. Moorhead

*Attorney, Agent, or Firm*—Robert H. Eckhoff

[57] ABSTRACT

A box construction is provided in which the top closure of the box is secured to each of the side walls in such a manner that once the top has been secured in place, it cannot be moved to an open position without such damage to the box that this is readily apparent. In this way, any attempt at pilferage is readily ascertained.

2 Claims, 6 Drawing Figures

TAMPER-PROOF CONTAINER

BACKGROUND OF THE INVENTION

It is common practice to package various relatively valuable commodities such as mushrooms in corrugated containers so that such commodities can be moved to market. While in transit, such commodities provide a desirable object for pilferage.

SUMMARY OF THE INVENTION

It is in general the broad object of the present invention to provide a box container such that any attempt at pilferage results in such destruction or alteration of the box structure that such attempt is readily observed, thus ensuring that the box and its contents will not be tampered with or the contents pilfered.

BRIEF DESCRIPTION OF THE PREFERRED EMBODIMENT

Figure 1:
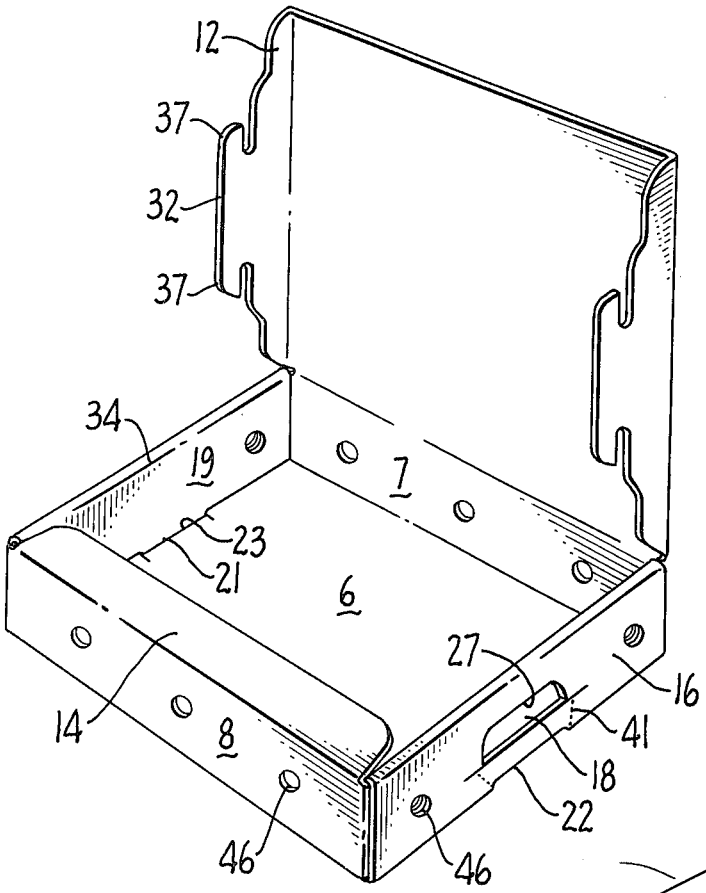
FIG. 1 is a perspective view showing the assembled box with the top in open position.
Figure 4:
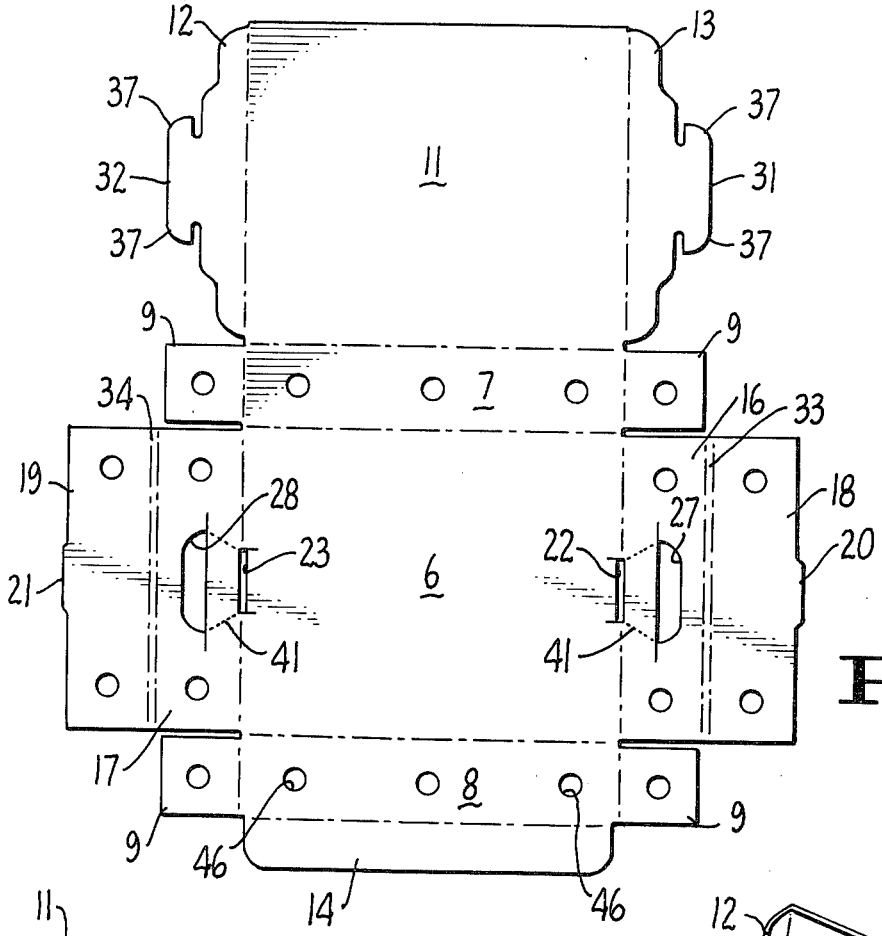
FIG. 4 is a plan view showing the entire box blank in plan view prior to assembly.
Figure 5:
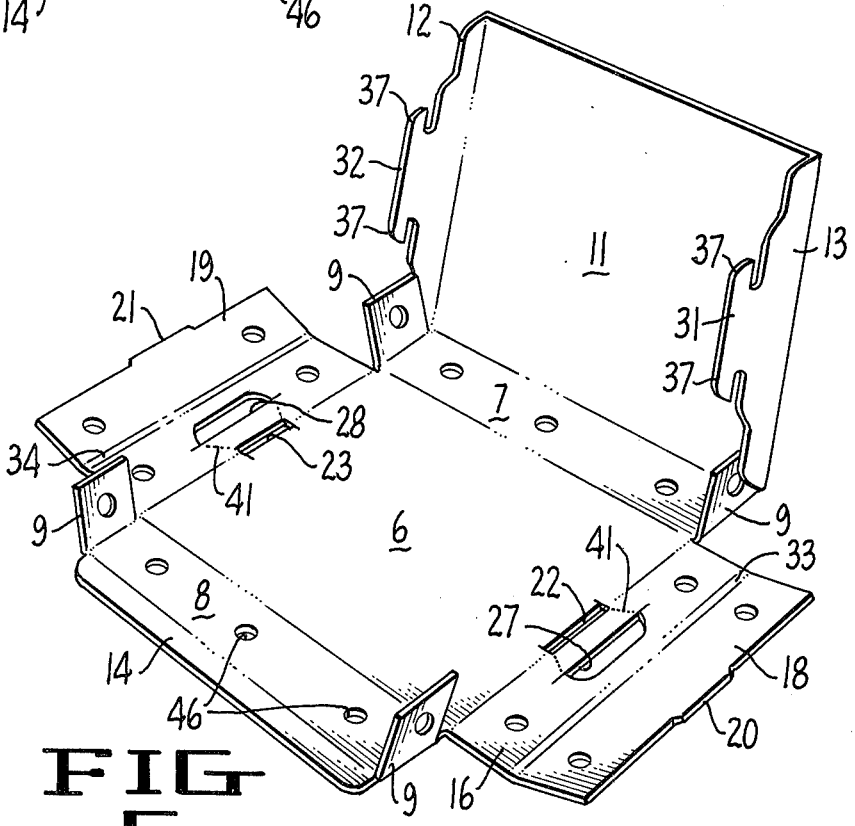
FIG. 5 is a perspective view illustrating one step in the assembly of the completed box.

Referring particularly to FIG. 4, the box blank includes a bottom 6, side walls 7 and 8 secured on opposite sides of the bottom. Each side wall includes interlocking flaps 9. The box blank is cut from a sheet of corrugated board which is well-known and includes a corrugated sheet of paper fastened to opposite facing sheets. Top 11 is secured to side wall 7 and includes opposite end flaps 12 and 13 which will be further described in detail. Side wall 8 includes a tongue 14 which is adapted to extend at 90° to side wall 8 as is shown in FIG. 1. End walls 16 and 17 are secured on opposite sides of the bottom 6. The end walls, in turn, include flaps 18 and 19 adapted to be folded in over the end flaps 9 when the box is undergoing assembly as is shown in FIGS. 1 and 5. Each of flaps 18 and 19 includes a short extension 20 and 21 to fit within cutout portions 22 and 23 in bottom 6 to lock flaps 18 and 19 in place.

In accordance with this invention, each of end walls 16 and 17 includes arcuate cutout portions 27 and 28. These are adapted to receive in locking engagement each of tongues 31 and 32 provided upon end flaps 12 and 13. The overall length of each tongue exceeds the width of the bottom of the cooperating arcuate portion by about an inch so that each tongue is held securely once it has been fixed into place in between a flap and an end wall.

To assemble the box, side walls 7 and 8 are moved into a position in which they extend upwardly at 90° to bottom 6 and the end flaps 9 are turned inwardly to extend toward one another along the bottom. Flaps 18 and 19 are then moved about score lines 33 and 34 to engage the end flaps 9 and to bring each of short extensions 20 and 21 into engagement with the cutout portions 22 and 23 in the bottom 6. When these steps are followed and tongue 14 is moved inwardly, the box structure will be in the form in which it appears in FIG. 1.

Figure 2:
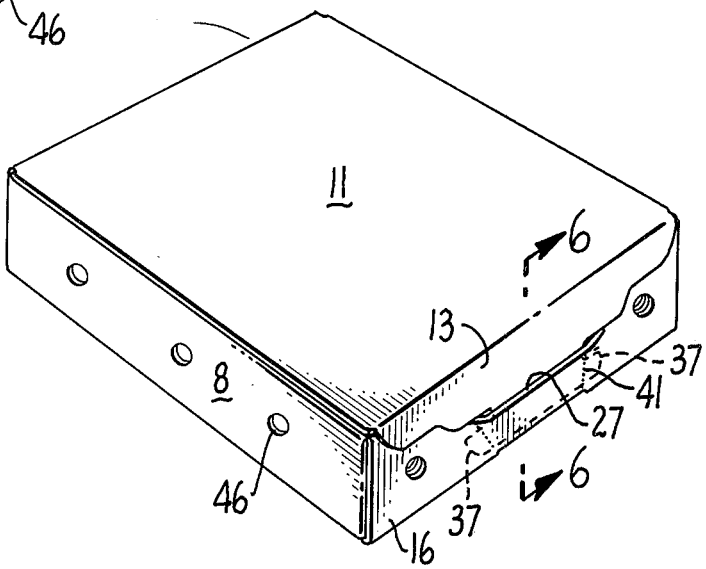
FIG. 2 is a perspective view similar to FIG. 1 but with the top secured and locked in place.
Figure 3:
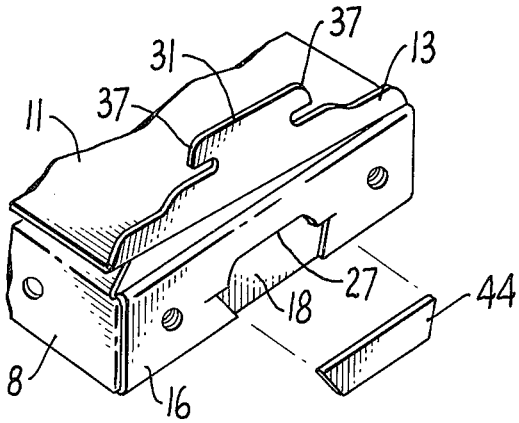
FIG. 3 is a perspective view of one end of a box showing the construction of the locking means provided between the top and an end portion of the box.
Figure 6:
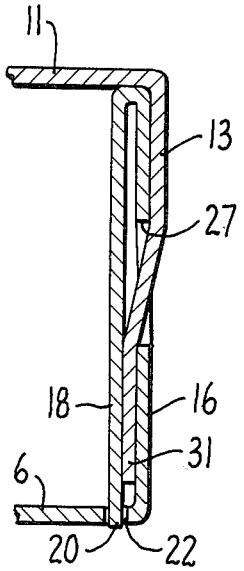
FIG. 6 is a section taken along the lines 6—6 in FIG. 2 showing the relation of the end wall and the box top lock.

In this position, the box is readily filled. The top is then moved into position so that the tongues 31 and 32 are snugly engaged with the cutout portions 27 and 28. Each of tongues 31 and 32 includes oppositely extending ears 37 which engage the opposite sides of the cutout portions 27 and 28 fitting snugly between the opposite end flaps 18 and 19 as appears in section in FIG. 6. Score lines 41 are provided on opposite sides of each of cutout portions 27 and 28. With the box assembled in that position which appears in FIG. 2, it is only possible to release the tongues 31 and 32 from the locking engagement with cutout portions 27 and 28 by physically pulling away that portion of each end wall 16 and 17 which is designated as 44 in FIG. 3, thus, physically altering the appearance of the box and giving a ready and clear indication that the box has been tampered with.

From the foregoing, it will be apparent that there has been provided a relatively simple but yet effective structure which is tamper-proof unless one intent upon pilferage is willing to run the risk of having his misdeed readily apparent. Apertures 46 are provided in the various elements to permit ready circulation of air through the assembled box.

I claim:

1. A self-locking tamper-proof container comprising:

a rectangular bottom panel having side edges and end edges and having coutouts therein adjacent the end edges thereof;

a pair of side walls having spaced side edges and each connected along a fold line at one side edge thereof to a respective side edge of said bottom panel;

a top rectangular panel having end edges and connected along a fold line to the other side edge of one of said side walls;

a pair of top panel end flaps foldably connected along fold lines to the end edges of said top panel and each end flap having a free edge spaced from the fold line, a T-shaped locking tongue on the free edge of each of said end flaps, said locking tongues each having a head portion having a pair of arcuate edged locking ears which extend in the direction of said top panel end edges and a base integral with said head and each said top end flap to connect said head to said end flaps so that said locking ears are each spaced from the free edges of said end flaps;

a pair of end panels having opposite side edges and each connected along a fold line at one side edge thereof to said end edges of said bottom panel;

a pair of end wall flaps connected along fold lines to the other side edges of said end panels, and having extension tabs on said other side edges thereof, said tabs received in said bottom panel cutouts when said end wall flaps are folded to be co-extensive with said end panels;

said end panels each having an elongated cutout portion defined therein to receive one of said locking ears with one edge of said locking ear head portion engaging said end panel along one edge of said elongated cutout portion to lock said container top panel to said end panel, said elongated cutout portions each having one side longer than the other, with said long side positioned between the short side and said bottom panel, and arcuate ends connecting said sides;

a tearout tab in each of said end panels defined by scorelines in said end panels which extend from said elongated cutout portion and which are removable from said each end panel to form a long side toward said bottom panel opening therein so that said locking ears are accessible from outside of the container and can be freed from engagement with said end panels while giving an indication that the container has been tampered with by physically altering the appearance of the container.

2. The container as in claim 1 wherein the overall length of each tongue is greater than the width of the cutout portion.

* * * * *